US009747844B2

(12) United States Patent
Diao et al.

(10) Patent No.: US 9,747,844 B2
(45) Date of Patent: Aug. 29, 2017

(54) BACKLIGHT BRIGHTNESS ADJUSTING METHOD AND DEVICE, AND LIQUID CRYSTAL DISPLAY DEVICE

(71) Applicant: Hisense Electric Co., Ltd., Qingdao (CN)

(72) Inventors: Yujie Diao, Qingdao (CN); Jia Yang, Qingdao (CN); Shunming Huang, Qingdao (CN)

(73) Assignees: HISENSE ELECTRIC CO., LTD., Qingdao (CN); HISENSE USA CORPORATION, Suwanee, GA (US); HISENSE INTERNATIONAL CO., LTD., Qingdao (CN)

( * ) Notice: Subject to any disclaimer, the term of this patent is extended or adjusted under 35 U.S.C. 154(b) by 32 days.

(21) Appl. No.: 14/745,751

(22) Filed: Jun. 22, 2015

(65) Prior Publication Data

US 2016/0260390 A1 Sep. 8, 2016

(30) Foreign Application Priority Data

Mar. 5, 2015 (CN) ..... 2015 1 0096109

(51) Int. Cl.
*G09G 3/34* (2006.01)

(52) U.S. Cl.
CPC ... *G09G 3/3406* (2013.01); *G09G 2320/0626* (2013.01); *G09G 2360/16* (2013.01)

(58) Field of Classification Search
CPC ..... G09G 3/3413; G09G 3/2003; G09G 3/36; G09G 3/3406; G09G 3/3607; G09G 3/2022
USPC ..... 345/691
See application file for complete search history.

(56) References Cited

U.S. PATENT DOCUMENTS

| | | | | |
|---|---|---|---|---|
| 9,336,702 | B2 * | 5/2016 | Kim | G09G 3/2003 |
| 2003/0117414 | A1 * | 6/2003 | Sasaki | G09G 3/006 345/589 |
| 2010/0060671 | A1 * | 3/2010 | Park | G09G 3/3413 345/690 |
| 2010/0207956 | A1 * | 8/2010 | Keh | G09G 3/3406 345/589 |
| 2010/0214201 | A1 * | 8/2010 | Chen | G09G 3/2003 345/88 |
| 2010/0214327 | A1 * | 8/2010 | Chen | G09G 3/3413 345/690 |
| 2011/0267381 | A1 * | 11/2011 | Yamazaki | G09G 3/3607 345/690 |

(Continued)

*Primary Examiner* — Fred Tzeng
(74) *Attorney, Agent, or Firm* — Harness, Dickey & Pierce, P.L.C.

(57) ABSTRACT

The disclosure discloses a backlight brightness adjusting method and device and a liquid crystal display device. In the backlight brightness adjusting method, grayscale characteristic values of respective primary colors in an image to be displayed are obtained, that is, contributions of the respective primary colors to an overall grayscale are obtained, to thereby obtain the grayscale contributions of the respective primary colors in the image to be displayed respectively; a backlight value is determined by giving different coefficients to the grayscale characteristic values of the respective primary colors; and finally an output of a backlight driver is adjusted according to the backlight value to thereby adjust backlight brightness.

17 Claims, 3 Drawing Sheets

(56) References Cited

U.S. PATENT DOCUMENTS

| | | | | |
|---|---|---|---|---|
| 2015/0366017 | A1* | 12/2015 | Xu | G09G 3/34 315/192 |
| 2016/0063688 | A1* | 3/2016 | Yang | H04N 5/44504 345/589 |
| 2016/0249427 | A1* | 8/2016 | Chen | G09G 3/34 |
| 2016/0267856 | A1* | 9/2016 | Chen | G09G 3/36 |
| 2016/0351104 | A1* | 12/2016 | Yaras | G09G 3/2022 |

* cited by examiner

BACKLIGHT BRIGHTNESS ADJUSTING METHOD AND DEVICE, AND LIQUID CRYSTAL DISPLAY DEVICE

CROSS-REFERENCE TO RELATED APPLICATION

This application claims the benefit and priority of Chinese Patent Application No. 201510096109.4 filed Mar. 5, 2015. The entire disclosure of the above application is incorporated herein by reference.

FIELD

The present disclosure relates to the field of display technologies and particularly to a backlight brightness adjusting method and device, and a liquid crystal display device.

BACKGROUND

This section provides background information related to the present disclosure which is not necessarily prior art.

The Liquid Crystal Display (LCD) technologies have been developed for many years. Liquid crystal molecules do not emit light themselves, so a display area is typically illuminated by a backlight source capable of emitting light at some grayscale. Currently, LCD backlight sources generally include Cold Cathode Fluorescent (CCFL) and Light Emitting Diode (LED) backlight sources, where the latter has been increasingly widely applied in the field of liquid crystal displays due to the long lifetime, short response time and other advantages of the LEDs.

SUMMARY

This section provides a general summary of the disclosure, and is not a comprehensive disclosure of its full scope or all of its features.

In an aspect, some embodiments of the disclosure provide a backlight brightness adjusting method including:

obtaining grayscale characteristic values of respective primary colors in an image to be displayed, wherein the grayscale characteristic values of the respective primary colors characterize contributions of grayscales of the respective primary colors to a grayscale of the image to be displayed;

determining a backlight value according to the grayscale characteristic values of the respective primary colors, and coefficients corresponding to the respective primary colors; and adjusting backlight brightness according to the backlight value.

In another aspect, some embodiments of the disclosure provide a backlight brightness adjusting device including:

a memory; and one or more processors, wherein the memory stores one or more computer readable program codes, and the one or more processors are configured to execute the one or more computer readable program codes to perform:

obtaining grayscale characteristic values of respective primary colors in an image to be displayed, wherein the grayscale characteristic values of the respective primary colors characterize contributions of grayscales of the respective primary colors to a grayscale of the image to be displayed;

determining a backlight value according to the grayscale characteristic values of the respective primary colors, and coefficients corresponding to the respective primary colors; and adjusting backlight brightness according to the backlight value.

Moreover some embodiments of the disclosure further provide a liquid crystal display device including the backlight brightness adjusting device above including:

a memory; and one or more processors, wherein the memory stores one or more computer readable program codes, and the one or more processors are configured to execute the one or more computer readable program codes to perform:

obtaining grayscale characteristic values of respective primary colors in an image to be displayed, wherein the grayscale characteristic values of the respective primary colors characterize contributions of grayscales of the respective primary colors to a grayscale of the image to be displayed;

determining a backlight value according to the grayscale characteristic values of the respective primary colors, and coefficients corresponding to the respective primary colors; and adjusting backlight brightness according to the backlight value.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

In order to improve contrast on a liquid crystal display and to reduce power consumption of the liquid crystal display, light of a backlight thereof is adjusted dynamically in the conventional art. Dynamic light adjusting of the backlight can be categorized into global light adjusting and local light adjusting dependent upon adjusting of brightness of the backlight.

In some embodiments, all of different images displayed on a display screen can be consisted of three primary colors including red, green and blue colors. There are two photosensitive cells in retinas of human eyes, so that the human eyes are sensitive differently to light at different wavelengths among illuminating white light at some grayscale. There are different wavelengths of visible light in different colors. As can be apparent, the wavelength of blue light is the shortest, so a pure-blue image is perceived by the human eyes at the darkest grayscale among a pure-red image, a pure-green image, and the pure-blue image at the same grayscale.

Figure 1:
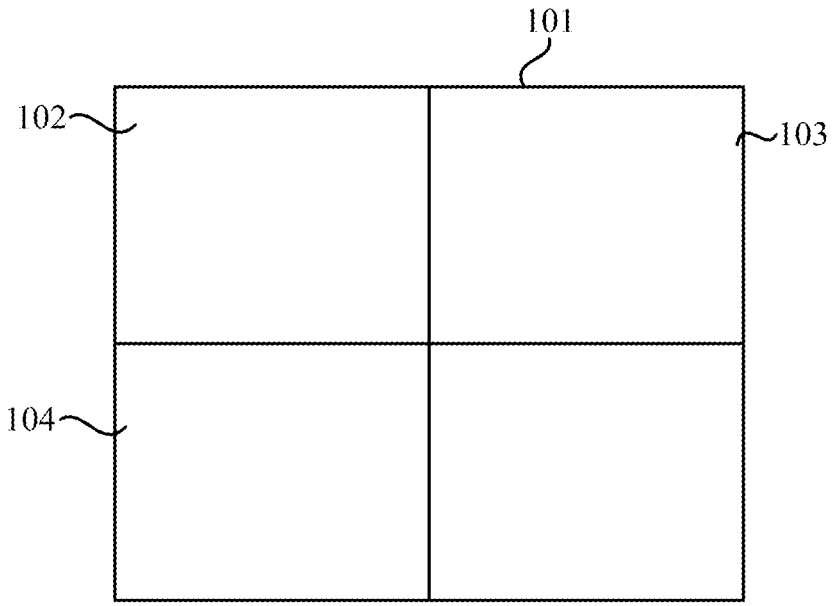
FIG. 1 illustrates a schematic diagram of an image to be displayed according to some embodiments of the disclosure.
Figure 2:
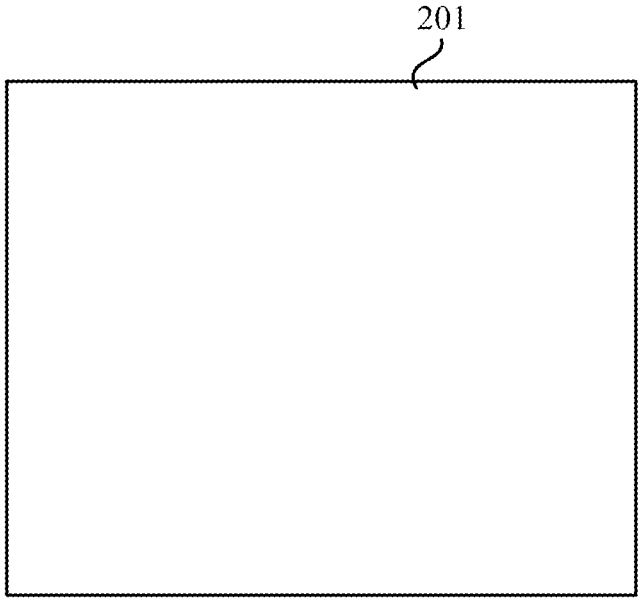
FIG. 2 illustrates a schematic diagram of another image to be displayed according to some embodiments of the disclosure.

It is desirable to provide a backlight brightness adjusting method and device so as to improve backlight brightness corresponding to a blue image displayed on a display screen. Some embodiments of the disclosure are applicable to a liquid crystal display device; and in some embodiments of the disclosure, an image to be displayed 201 may be an entire frame, and as illustrated in FIG. 2, in some embodiments of this disclosure, an image to be displayed is an image to be displayed on a liquid crystal display screen. In this situation, a backlight area of the liquid crystal display device will not be divided into a plurality of backlight subareas, that is, the entire backlight is adjusted by obtaining grayscales of the image to be displayed. In another situation, the image to be displayed may be some subarea of a frame 101, and the format of subareas of the frame may be determined in a design phase, and at this time, the backlight area of the liquid crystal display device may be divided into a plurality of backlight subareas. As illustrated in FIG. 1, the frame may be divided into four subareas, and the image in each subarea of the frame may be a separate image to be displayed, so that the backlight brightness in a backlight subarea of the liquid crystal display device may be adjusted according to grayscale information of the corresponding image to be displayed.

Based upon the discussion above, some embodiments of the disclosure may be applicable to a liquid crystal display device including a backlight area divided into a plurality of backlight subareas or a liquid crystal display device including a backlight area not divided into a plurality of backlight subareas, but the embodiments of the disclosure will not be limited in this regard. In some embodiments, if the backlight area of the liquid crystal display device is divided into a plurality of backlight subareas, the backlight source in each backlight subarea can be controlled separately to emit light. In the following description of the disclosure, the technical solutions according to the disclosure will be described by way of an example where the image to be displayed is some subarea of a frame, that is, the backlight area of the liquid crystal display device is divided into a plurality of backlight subareas, and each subarea of the frame corresponds to one backlight subarea in the backlight area of the liquid crystal display device.

Those skilled in the art may appreciate that the frame in this disclosure may be a frame of video or a frame of image, and frames including images to be displayed on the display screen of the liquid crystal display device are displayed in sequence on the display screen. By way of an example referring to FIG. 1, in a frame 101, an image to be displayed 102 corresponding to a first subarea of the frame 101 in FIG. 1 is a pure-blue image, an image to be displayed 103 corresponding to a second subarea of the frame 101 is a pure-green image, and an image to be displayed 104 corresponding to a third subarea of the frame 101 is a pure-red image. At this time all of backlight sources corresponding to the backlight subareas corresponding to the image to be displayed 102, the image to be displayed 103, and the image to be displayed 104 may provide the same backlight value, where the backlight value is calculated from the grayscale of the image to be displayed to drive the corresponding backlight source. Since the pure-blue image is perceived by human eyes as the darkest image among the pure-red image, the pure-green image, and the pure-blue image at the same grayscale given the same backlight brightness, so a part of a picture corresponding to the image to be displayed 102 displayed on the display screen is perceived by the human eyes as a darker part.

For this reason, some embodiments of the disclosure provide a backlight adjusting method, where a backlight value corresponding to a backlight subarea in the liquid crystal display device needs to be determined in the embodiment illustrated in FIG. 1. In some embodiments of the disclosure, after the backlight value is determined, a drive circuit of the liquid crystal display device is further controlled by a controller to adjust backlight brightness in the backlight subarea.

In the disclosure, backlight brightness in some backlight subarea may be adjusted according to a backlight value corresponding to the backlight subarea by converting the backlight value into a duty ratio of a drive signal and inputting the drive signal with the duty ratio to a backlight drive circuit so that the backlight drive circuit drives a backlight source to output backlight brightness corresponding to the backlight value. The backlight value ranges from 0 to 255, and if the amplitude of current of the backlight drive circuit is 240 mA, and the duty ratio of current ranges from 0 to 100, and if the backlight value is determined as 120, then the determined backlight value may be converted into a duty ratio, that is, the ratio of the backlight value 120 to the amplitude of current 240 is multiplied by to determine the duty ratio of 50 as a result of conversion, and the signal with the duty ratio of 50 is input to the backlight drive circuit so that the backlight drive circuit drives the backlight source to output backlight brightness corresponding to the backlight value.

Figure 3:
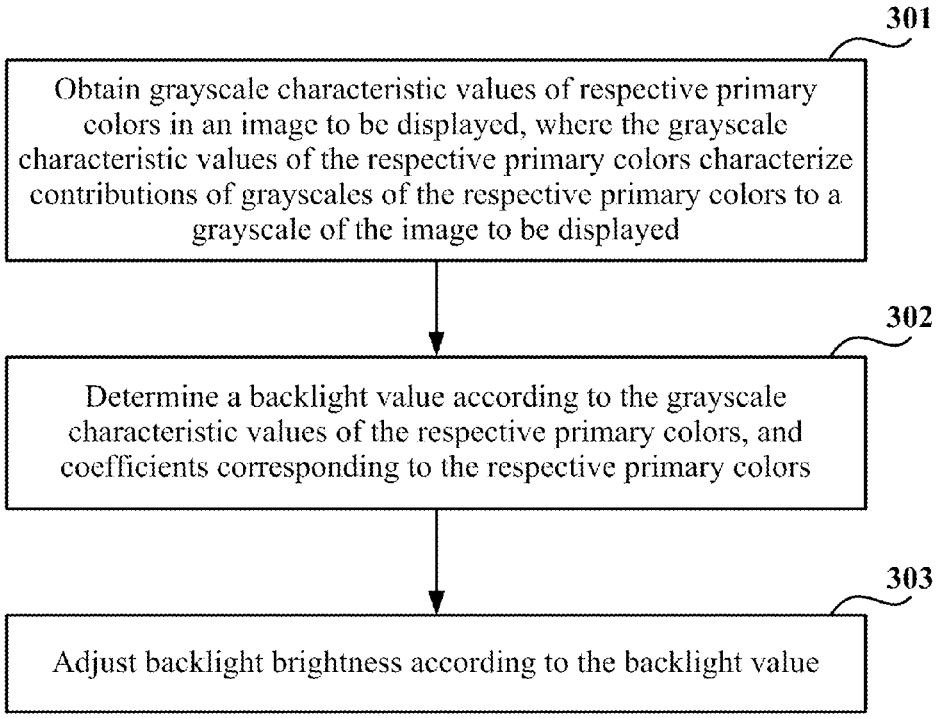
FIG. 3 illustrates a schematic flow chart of a backlight brightness adjusting method according to some embodiments of the disclosure.

FIG. 3 illustrates a schematic flow chart of a backlight brightness adjusting method according to some embodiments of this disclosure.

Further to the disclosure above, a backlight brightness adjusting method according to some embodiments of the disclosure, applicable to a liquid crystal display device, may include the following operations:

The operation 301 is to obtain grayscale characteristic values of respective primary colors in an image to be displayed, where the grayscale characteristic values of the respective primary colors characterize contributions of grayscales of the respective primary colors to a grayscale of the image to be displayed;

The operation 302 is to determine a backlight value according to the grayscale characteristic values of the respective primary colors, and coefficients corresponding to the respective primary colors, where the coefficient corresponding to the blue color is the largest among the coefficients corresponding to the respective primary colors; and The operation 303 is to adjust backlight brightness according to the backlight value.

As described above, in some embodiments, a backlight area of the liquid crystal display device to which the method according to some embodiments of the disclosure may be applicable may be divided into M backlight subareas, where the backlight area of the liquid crystal display device is not divided when M is equal to 1; and the backlight area of the liquid crystal display device is dived into two or more backlight subareas when M is equal to or more than 2. This embodiment will be described taking a subarea of a frame as an example. In an implementation, the backlight subareas of the liquid crystal display device may be preset, and backlight brightness in each backlight subarea may be controlled separately.

In the operation 301 above, the grayscale characteristic values of the respective primary colors in the image to be displayed are obtained, where the grayscale characteristic values of the respective primary colors characterize the contributions of grayscales of the respective primary colors to the grayscale in the image to be displayed.

For example, in the situation as illustrated in FIG. 1, a frame may be divided into four subareas, each of which corresponds to an image to be displayed, and grayscale characteristic values of respective primary colors in the image to be displayed, i.e. contributions of the respective primary colors to an overall grayscale, are obtained to thereby obtain the contributions of the respective primary colors in the image to be displayed. Since a color image may be consisted of three primary colors, i.e., the red, green and blue colors, grayscale information of the image to be displayed may be consisted of red grayscale information, green grayscale information, and blue grayscale information. The contributions refer to that the red grayscale characteristic value, the green grayscale characteristic value, and the blue grayscale characteristic value in the image to be displayed are converted into the overall grayscale in the image to be displayed so that the sum of the grayscale characteristic values of the respective primary colors contribute to the corresponding grayscale in the image to be displayed. For example, if an overall grayscale in an image to be displayed is 200, and a contribution of the red color to the overall grayscale is 100, that is, red grayscale information in the image to be displayed contributes a grayscale in the image to be displayed, a contribution of the green color to the overall grayscale is 60, and a contribution of the blue color to the overall grayscale is 40, then there are a red grayscale characteristic value of 100, a green grayscale characteristic value of 60, and a blue grayscale characteristic value of 40. The red grayscale characteristic value, the green grayscale characteristic value, and the blue grayscale characteristic value are obtained in this operation.

In some embodiments, the grayscale characteristic values of the respective primary colors in the image to be obtained may be obtained particularly in the following operations:

1. Grayscales of respective pixels in the image to be displayed are obtained;

2. First grayscales and grayscale proportions of the respective primary colors in the image to be displayed are determined according to the grayscales of the respective pixels; and 3. The grayscale characteristic values of the respective primary colors are determined according to the products of the first grayscales and the grayscale proportions of the respective primary colors.

Here the first grayscales of the respective primary colors may characterize grayscale information of the respective primary colors in the image to be displayed.

In some embodiments, the first grayscales of the respective primary colors in the image to be displayed may be determined according to the grayscales of the respective pixels in the following two approaches:

In a first approach, a first grayscale in the image to be displayed is determined according to the grayscales of the respective pixels in the image to be displayed, and further all of a red first grayscale, a green first grayscale, and a blue first grayscale in the image to be displayed are set to the determined first grayscale in the image to be displayed.

In a second approach, a red first grayscale in the image to be displayed is determined according to red grayscales of the respective pixels in the image to be displayed; a green first grayscale in the image to be displayed is determined according to green grayscales of the respective pixels in the image to be displayed; and a blue first grayscale in the image to be displayed is determined according to blue grayscales of the respective pixels in the image to be displayed.

In the second approach above, the overall grayscale of each pixel may be consisted of the red grayscale, the green grayscale, and the blue grayscale. So the red grayscale, the green grayscale, and the blue grayscale of each pixel in the image to be displayed are obtained, and the red first grayscale in the image to be displayed is determined according to the red grayscales of the respective pixels in the image to be displayed; the green first grayscale in the image to be displayed is determined according to the green grayscales of the respective pixels in the image to be displayed; and the blue first grayscale in the image to be displayed is determined according to the blue grayscales of the respective pixels in the image to be displayed. In the second approach, the red first grayscale, the green first grayscale, and the blue first grayscale in the image to be displayed, which are calculated from the red grayscales, the green grayscales, and the blue grayscales of the respective pixels may be different from each other. Since the red first grayscale, the green first grayscale, and the blue first grayscale in the image to be displayed are calculated from the red grayscales, the green grayscales, and the blue grayscales of the respective pixels in the second approach, particular conditions of the three primary colors in the image to be displayed may be expressed more precisely to thereby facilitate a further improvement in precision of the a backlight value.

In the first approach or the second approach, the red first grayscale, the green first grayscale, and the blue first grayscale in the image to be displayed may be determined according to the grayscales of the respective pixels in the image to be displayed in a number of algorithms, e.g., by calculating the average, calculating the weighted sum of the average and the maximum, calculating a root mean squared value, etc. Some of the embodiment of the disclosure will illustrate calculating the average and calculating the weighted sum of the average and the maximum by way of an example, and the respective coefficients in the algorithm are normal values which may be selected for particular scenarios in which the algorithm is applicable, but the magnitudes of the coefficients in some of the embodiment of the disclosure will not be defined.

In the first approach above, determining the red first grayscale, the green first grayscale, and the blue first grayscale in the image to be displayed by calculating the average may be as follows: determining the average of the grayscales of all the pixels in the image to be displayed, according to the grayscales of the respective pixels in the image to be displayed, where the average of the grayscales of all the pixels in the image to be displayed is the red first grayscale in the image to be displayed, the average of the grayscales of all the pixels in the image to be displayed is the green first grayscale in the image to be displayed, and the average of the grayscales of all the pixels in the image to be displayed is the blue first grayscale in the image to be displayed.

In the first approach above, determining the red first grayscale, the green first grayscale, and the blue first grayscale in the image to be displayed by calculating the weighted sum of the average and the maximum may be as follows: calculating the average of the grayscales of all the pixels in the image to be displayed, and weighted summing up the maximum of the grayscales of all the pixels in the image to be displayed and the average of the grayscales to obtain a second grayscale corresponding to the image to be displayed; and further setting all of the red first grayscale, the green grayscale, and the blue grayscale corresponding to the image to be displayed to the determined second grayscale corresponding to the image to be displayed. the maximum of the grayscales of all the pixels in the image to be displayed and the average of the grayscales may be weighted summed up particularly by multiplying the maximum of the grayscales of all the pixels in the image to be displayed by a coefficient corresponding to the maximum of the grayscales of all the pixels in the image to be displayed, multiplying the average of the grayscales of all the pixels in the image to be displayed by a coefficient corresponding to the average of the grayscales of all the pixels in the image to be displayed, and summing up two resulting products.

By way of an example, there are four pixels in total in the image to be displayed, and grayscales of the respective pixels are as depicted in Table 1.

TABLE 1

Grayscales of the four pixels in the first example

| Pixels in the image to be displayed | Grayscales of the pixels |
|---|---|
| Grayscale of the first pixel | 120 |
| Grayscale of the second pixel | 160 |
| Grayscale of the third pixel | 124 |
| Grayscale of the fourth pixel | 100 |
| The average of the grayscales of all the pixels in the image to be displayed | 126 |
| The maximum of the grayscales of all the pixels in the image to be displayed | 160 |
| The second grayscale of the image to be displayed | c * 160 + d * 126 |
| The red first grayscale corresponding to the image to be displayed | c * 160 + d * 126 |
| The green first grayscale corresponding to the image to be displayed | c * 160 + d * 126 |
| The blue first grayscale corresponding to the image to be displayed | c * 160 + d * 126 |

As may be apparent from Table 1, the grayscale of the first pixel is 120, the grayscale of the second pixel is 160, the grayscale of the third pixel is 124, and the grayscale of the fourth pixel is 100. The average of the grayscales of all the pixels in the image to be displayed is calculated as the average of 120, 160, 124 and 100, so that the average of the grayscales of all the pixels in the image to be displayed is calculated as 126. The maximum of the grayscales of all the pixels in the image to be displayed is 160. The maximum of the grayscales of all the pixels in the image to be displayed and the average of the grayscales are weighted summed up to obtain the second grayscale corresponding to the image to be displayed. If the coefficient corresponding to the maximum of the grayscales of all the pixels in the image to be displayed is c, and the coefficient corresponding to the average of the grayscales of all the pixels in the image to be displayed is d, then the second grayscale corresponding to the image to be displayed is equal to the sum of the product of the coefficient c corresponding to the maximum of the grayscales of all the pixels in the image to be displayed and the maximum 160 of the grayscales of all the pixels in the image to be displayed, and the product of the coefficient d corresponding to the average of the grayscales of all the pixels in the image to be displayed and the average 126 of the grayscales of all the pixels in the image to be displayed, i.e., c*160+d*126=the second grayscale corresponding to the image to be displayed. All of the red first grayscale, the green first grayscale, and the blue first grayscale corresponding to the image to be displayed are set to the determined second grayscale corresponding to the image to be displayed.

In the second approach above, determining the red first grayscale, the green first grayscale, and the blue first grayscale corresponding to the image to be displayed by calculating the average may be as follows: calculating the average of the red grayscales of all the pixels in the image to be displayed to obtain the red first grayscale corresponding to the image to be displayed; calculating the average of the green grayscales of all the pixels in the image to be displayed to obtain the green first grayscale corresponding to the image to be displayed; and calculating the average of the blue grayscales of all the pixels in the image to be displayed to obtain the blue first grayscale corresponding to the image to be displayed.

In the second approach above, determining the red first grayscale, the green first grayscale, and the blue first grayscale corresponding to the image to be displayed by calculating the weighted sum of the average and the maximum may be as follows: calculating the average of the red grayscales of all the pixel points in the image to be displayed, and weighted summing up the maximum of the red grayscales of all the pixel points in the image to be displayed and the average of the red grayscales to obtain the red first grayscale corresponding to the image to be displayed; calculating the average of the green grayscales of all the pixel points in the image to be displayed, and weighted summing up the maximum of the green grayscales of all the pixel points in the image to be displayed and the average of the green grayscales to obtain the green first grayscale corresponding to the image to be displayed; and calculating the average of the blue grayscales of all the pixel points in the image to be displayed, and weighted summing up the maximum of the blue grayscales of all the pixel points in the image to be displayed and the average of the blue grayscales to obtain the blue first grayscale corresponding to the image to be displayed.

In some embodiments, the grayscale of each pixel may be consisted of a red grayscale, a green grayscale, and a blue grayscale. By way of an example, there are four pixels in total in the image to be displayed, and grayscales of the respective pixels are as depicted in Table 2.

TABLE 2

Grayscales of the four pixels in the second example

| Pixels in the image to be displayed | | Grayscales of the pixels |
|---|---|---|
| First pixel | Red grayscale | 100 |
| | Green grayscale | 50 |
| | Blue grayscale | 120 |
| Second pixel | Red grayscale | 90 |
| | Green grayscale | 60 |
| | Blue grayscale | 130 |
| Third pixel | Red grayscale | 85 |
| | Green grayscale | 24 |
| | Blue grayscale | 75 |
| Fourth pixel | Red grayscale | 45 |
| | Green grayscale | 26 |
| | Blue grayscale | 55 |

TABLE 2-continued

Grayscales of the four pixels in the second example

| Pixels in the image to be displayed | Grayscales of the pixels |
|---|---|
| The average of the red grayscales of all the pixels in the image to be displayed | 80 |
| The maximum of the red grayscales of all the pixels in the image to be displayed | 100 |
| The red first grayscale of all the pixels in the image to be displayed | c * 100 + d * 80 |
| The average of the green grayscales of all the pixels in the image to be displayed | 40 |
| The maximum of the green grayscales of all the pixels in the image to be displayed | 60 |
| The green first grayscale of all the pixels in the image to be displayed | c * 60 + d * 40 |
| The average of the blue grayscales of all the pixels in the image to be displayed | 95 |
| The maximum of the blue grayscales of all the pixels in the image to be displayed | 130 |
| The blue first grayscale of all the pixels in the image to be displayed | c * 130 + d * 95 |

Table 2 will be described below taking the blue first grayscale of all the pixels in the image to be displayed as an example, but the same will apply to the green and red first grayscales, so a repeated description thereof will be omitted here. As may be apparent from Table 2, the blue grayscale of the first pixel is 120, the blue grayscale of the second pixel is 130, the blue grayscale of the third pixel is 75, and the blue grayscale of the fourth pixel is 55. The average of the blue grayscales of all the pixels in the image to be displayed is calculated as the average of 120, 130, 75 and 55 so that the average of the blue grayscales of all the pixels in the image to be displayed is 95. The maximum of the blue grayscales of all the pixels in the image to be displayed is 130. The maximum of the blue grayscales of all the pixels in the image to be displayed and the average of the blue grayscales are weighted summed up to obtain the blue first grayscale corresponding to the image to be displayed. If the coefficient corresponding to the maximum of the blue grayscales of all the pixels in the image to be displayed is c, and the coefficient corresponding to the average of the blue grayscales of all the pixels in the image to be displayed is d, then the blue first grayscale corresponding to the image to be displayed is equal to the sum of the product of the coefficient c corresponding to the maximum of the blue grayscales of all the pixels in the image to be displayed and the maximum 130 of the blue grayscales of all the pixels in the image to be displayed, and the product of the coefficient d corresponding to the average of the blue grayscales of all the pixels in the image to be displayed and the average 95 of the blue grayscales of all the pixels in the image to be displayed, i.e., c*130+d*95=the blue first grayscale of all the pixels in the image to be displayed. c*100+d*80=the red first grayscale of all the pixels in the image to be displayed, and c*60+d*40=the green first grayscale of all the pixels in the image to be displayed are calculated similarly. The values of the coefficients c and d in both the first and second examples may be customized, and the embodiment of the disclosure will not be limited in this regard. The coefficients c and d assumed in the first example are reused in the second example according to the embodiment of the disclosure for the sake of a convenient description.

In some embodiments, the grayscale characteristic values of the respective primary colors need to be obtained by further determining the grayscale proportions of the respective primary colors in the image to be displayed, i.e., the red grayscale proportion, the green grayscale proportion, and the blue grayscale proportion. This may be performed concurrently as obtaining the first grayscales of the respective primary colors. For example, after the grayscales of the respective pixels in the image to be displayed are obtained, the first grayscales and the grayscale proportions of the respective primary colors may be determined concurrently according to the obtained grayscales of the respective pixels. "Concurrently" refers to two process threads being executed concurrently or being executed at the same time in the temporal sense. In another embodiment, this may be performed serially with obtaining the first grayscales of the respective primary colors, that is, the first grayscales of the respective primary colors, and the grayscale proportions of the respective primary colors may be obtained sequentially after the grayscales of the respective pixels in the image to be displayed are obtained. The embodiment of the disclosure will not be limited in this respect.

In some embodiments, the red grayscale proportion, the green grayscale proportion, and the blue grayscale proportion corresponding to the image to be displayed may be calculated by determining the red grayscale proportion R, the green grayscale proportion G, and the blue grayscale proportion B corresponding to the image to be displayed respectively in the equations of $$R = \frac{R_1}{R_1 + G_1 + B_1},\ G = \frac{G_1}{R_1 + G_1 + B_1} \text{ and } B = \frac{B_1}{R_1 + G_1 + B_1},$$

where $R_1$ represents the sum of the red grayscales of all the pixels in the image to be displayed, $G_1$ represents the sum of the green grayscales of all the pixels in the image to be displayed, and $B_1$ represents the sum of the blue grayscales of all the pixels in the image to be displayed. For example, firstly the sum $R_1$ of the red grayscales of all the pixels in the image to be displayed, the sum $G_1$ of the green grayscales of all the pixels in the image to be displayed, and the sum $B_1$ of the blue grayscales of all the pixels in the image to be displayed are calculated, and then the red grayscale proportion R corresponding to the image to be displayed is calculated as $$R = \frac{R_1}{R_1 + G_1 + B_1};$$

the green grayscale proportion G corresponding to the image to be displayed is calculated as $$G = \frac{G_1}{R_1 + G_1 + B_1};$$

and the blue grayscale proportion B corresponding to the image to be displayed is calculated as $$B = \frac{B_1}{R_1 + G_1 + B_1}.$$

Taking the blue grayscale proportion as an example and referring to the data in Table 2, the sum $R_1$ of the red grayscales of all the pixels in the image to be displayed, the sum $G_1$ of the green grayscales of all the pixels in the image to be displayed, and the sum $B_1$ of the blue grayscales of all the pixels in the image to be displayed are calculated as 320, 160 and 380 respectively, and the blue grayscale proportion B corresponding to the image to be displayed is calculated as approximately 44.2% according to $$B = \frac{B_1}{R_1 + G_1 + B_1}.$$

Similarly the red grayscale proportion R and the green grayscale proportion G are calculated as 37.2% and 18.6% respectively.

Moreover the grayscale proportions may alternatively be calculated by calculating the numbers of the pixels in the respective primary colors. For example, the ratios of the numbers of corresponding pixels in the respective primary colors with grayscales exceeding a preset threshold to the total number of pixels exceeding the preset threshold are determined.

After the red grayscale proportion, the green grayscale proportion, and the blue grayscale proportion corresponding to the image to be displayed are calculated, the grayscale characteristic values of the respective primary colors in the image to be displayed may be determined in connection with the red first grayscale, the green first grayscale, and the blue first grayscale described above.

The grayscale characteristic values of the respective primary colors are determined according to the first grayscales and the grayscale proportions of the respective primary colors, for example, the red grayscale characteristic value is generated as the product of the red first grayscale and the red grayscale proportion; the green grayscale characteristic value is generated as the product of the green first grayscale and the green grayscale proportion; and the blue grayscale characteristic value is generated as the product of the blue first grayscale and the blue grayscale proportion.

The backlight value is determined according to the grayscale characteristic values of the respective primary colors, and the coefficients corresponding to the respective primary colors in the operation 302, where the coefficient corresponding to the blue color is the largest among the coefficients corresponding to the respective primary colors.

In some embodiments, the backlight value is determined as the sum of the products of the grayscale characteristic values of the respective primary colors and the coefficients corresponding to the respective primary colors. After the grayscale characteristic values of the respective primary colors are determined, the different primary colors are given the different coefficients to thereby adjust the backlight for the image to be displayed. In some of the embodiment of the disclosure, the coefficient corresponding to the blue color is larger than the coefficient corresponding to the red color, and also larger than the coefficient corresponding to the green color so that the brightness of the backlight will be higher for the image with a higher blue proportion to thereby address the problem in the prior art that the blue image appears to be visually dark. Optionally the coefficient corresponding to the green color is the smallest among the coefficients corresponding to the three primary colors.

In some embodiments, the first product of the red grayscale characteristic value and a first coefficient, the second product of the green grayscale characteristic value and a second coefficient, and the third product of the blue grayscale characteristic value and a third coefficient are determined, and the sum of the first product, the second product, and the third product is calculated to obtain the backlight value of the image to be displayed, where the first coefficient is the coefficient corresponding to the red color, the second coefficient is the coefficient corresponding to the green color, and the third coefficient is the coefficient corresponding to the blue color. The third coefficient is the largest because visual brightness of the blue image (i.e., brightness perceived by the human eyes) is the lowest at the same backlight brightness. In an implementation, the first coefficient may be equal to the second coefficient, or the first coefficient may be larger than the second coefficient, and optionally the first coefficient is larger than the second coefficient because visual brightness of the green image is the highest at the same backlight brightness; and optionally the first coefficient is 1, the second coefficient is less than 1, and the third coefficient is more than 1.

Then the following calculation equation may be obtained:

(The backlight value of the image to be displayed)= (the red grayscale characteristic value)*(the first coefficient)+(the green grayscale characteristic value)*(the second coefficient)+(the blue grayscale characteristic value)*(the third coefficient), where "*" represents "multiplied by".

After the backlight value of the image to be displayed is calculated in the equation above, further judgment needs to be made for that: different coefficients are given thus the calculated backlight value of the image to be displayed may be more than the maximum grayscale of 255.

In view of this, such a process is performed that the sum of the first product, the second product, and the third product is calculated; and it is judged whether the sum of the first product, the second product, and the third product is more than 255; and if so, then the backlight value of the image to be displayed is set to 255; otherwise, the backlight value of the image to be displayed is set to the sum of the first product, the second product, and the third product.

In some embodiments, the backlight value of the image to be displayed is calculated in the flow above where the grayscale characteristic value of the blue color is multiplied by the third coefficient, and the third coefficient corresponding to the blue color is the maximum of the three coefficients, if the blue component is prominent in the scene of the image to be displayed, that is, there is a high proportion of the blue grayscale in the scene, the backlight brightness corresponding to the image to be displayed may be improved effectively in the method according to some of the embodiment of the disclosure.

In some embodiments of the disclosure, after the backlight value of the image to be displayed is determined, the backlight value is converted into a signal input to a backlight drive circuit corresponding to the image to be displayed, and the backlight drive circuit drives a backlight source corresponding to the image to be displayed to generate corresponding backlight brightness, so that a user may perceive the grayscale of the picture displayed in the subarea of the display screen as the grayscale adjusted in the embodiment of the disclosure.

In some embodiments of this disclosure, the grayscale characteristic values of the respective primary colors in the image to be displayed are obtained, that is, the contributions of the respective primary colors to the overall grayscale are obtained, to thereby obtain the grayscale contributions of the respective primary colors in the image to be displayed respectively; a backlight value is determined by giving different coefficients to the grayscale characteristic values of the respective primary colors, where the coefficient corresponding to the blue color is the maximum of the coefficients corresponding to the respective primary colors; and finally the output of a backlight driver is adjusted according to the backlight value to thereby adjust the backlight brightness. The contributions of the respective primary colors in the image to be displayed to the overall grayscale are determined, and the grayscale characteristic value of the blue color is given the higher coefficient, to thereby adjust the backlight brightness. Since the coefficient corresponding to the blue color is larger than the coefficients corresponding to the other two primary colors, the backlight for the blue image may be provided with higher backlight brightness to thereby satisfy a visual demand of human beings.

It should be noted that the backlight brightness adjusting method described above may be performed by a processor in a liquid crystal display device.

Figure 4:
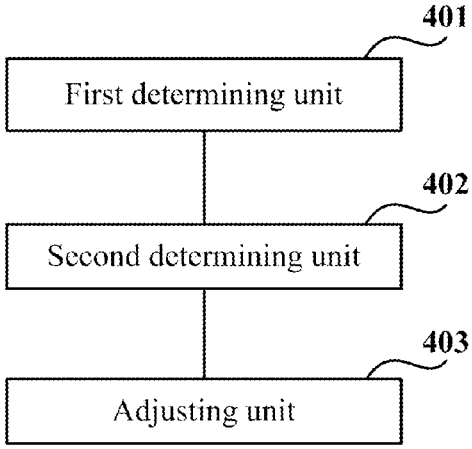
FIG. 4 illustrates a schematic structural diagram of a backlight brightness adjusting device according to some embodiments of the disclosure.

FIG. 4 illustrates a schematic structural diagram of a backlight brightness adjusting device in some embodiments of this disclosure.

Based upon the similar idea, an embodiment of the disclosure provides a backlight brightness adjusting device, applicable to a liquid crystal display device, to perform the flow in the embodiment of the method above, and the backlight brightness adjusting device may include a first determining unit 401, a second determining unit 402, and an adjusting unit 403, where:

The first determining unit 401 is configured to obtain grayscale characteristic values of respective primary colors in an image to be displayed, where the grayscale characteristic values of the respective primary colors characterize contributions of grayscales of the respective primary colors to a grayscale of the image to be displayed;

The second determining unit 402 is configured to determine a backlight value according to the grayscale characteristic values of the respective primary colors, and coefficients corresponding to the respective primary colors, where the coefficient corresponding to the blue color is the largest among the coefficients corresponding to the respective primary colors; and The adjusting unit 403 is configured to adjust backlight brightness according to the backlight value.

In some embodiments, the image to be display may be a frame or may be a subarea of a frame.

In some embodiments, for the image to be displayed, the first determining unit 401 is configured to obtain grayscales of respective pixels in the image to be displayed; to determine first grayscales and grayscale proportions of the respective primary colors in the image to be displayed according to the grayscales of the respective pixels; and to determine the grayscale characteristic values of the respective primary colors according to the products of the first grayscales and the grayscale proportions of the respective primary colors.

In some embodiments, the first determining unit 401 may be configured to determine a red first grayscale in the image to be displayed according to red grayscales of the respective pixels; to determine a green first grayscale in the image to be displayed according to green grayscales of the respective pixels; and to determine a blue first grayscale in the image to be displayed according to blue grayscales of the respective pixels, particularly by calculating the average of the red grayscales of all the pixels in the image to be displayed, and weighted summing up the maximum of the red grayscales of all the pixels in the image to be displayed and the average of the red grayscales of all the pixels in the image to be displayed to obtain the red first grayscale in the image to be displayed; calculating the average of the green grayscales of all the pixels in the image to be displayed, and weighted summing up the maximum of the green grayscales of all the pixels in the image to be displayed and the average of the green grayscales of all the pixels in the image to be displayed to obtain the green first grayscale in the image to be displayed; and calculating the average of the blue grayscales of all the pixels in the image to be displayed, and weighted summing up the maximum of the blue grayscales of all the pixels in the image to be displayed and the average of the blue grayscales of all the pixels in the image to be displayed to obtain the blue first grayscale in the image to be displayed.

In some embodiments, the first determining unit 401 may be further configured to sum up the red grayscales of the respective pixels in the image to be displayed to obtain the sum of the red grayscales of all the pixels $R_1$, to sum up the green grayscales of the respective pixels in the image to be displayed to obtain the sum of the green grayscales of all the pixels $G_1$, and to sum up the blue grayscales of the respective pixels in the image to be displayed to obtain the sum of the blue grayscales of all the pixels $B_1$; and to determine the red grayscale proportion R, the green grayscale proportion G, and the blue grayscale proportion B corresponding to the image to be displayed respectively in the equations of $$R = \frac{R_1}{R_1 + G_1 + B_1},\ G = \frac{G_1}{R_1 + G_1 + B_1} \text{ and } B = \frac{B_1}{R_1 + G_1 + B_1}.$$

In some embodiments, the first determining unit 401 may be configured to determine the grayscale characteristic values of the respective primary colors in the image to be displayed according to the products of the first grayscales and the grayscale proportions of the respective primary colors.

In some embodiments, the second determining unit 402 is configured to determine a first product of the red grayscale characteristic value and a first coefficient, to determine a second product of the green grayscale characteristic value and a second coefficient, and to determine a third product of the blue grayscale characteristic value and a third coefficient, where the first coefficient is the coefficient corresponding to the red color, the second coefficient is the coefficient corresponding to the green color, and the third coefficient is the coefficient corresponding to the blue color; and to sum up the first product, the second product, and the third product to obtain the backlight value.

In some embodiments, the second determining unit is further configured to calculate the sum of the first product, the second product, and the third product; and to set the backlight value to the sum of the first product, the second product, and the third product when the sum of the first product, the second product, and the third product is no more than 255.

In some embodiments, the first coefficient is larger than the second coefficient.

In some embodiments, the adjusting unit 403 is configured to adjust backlight brightness according to the backlight value generated by the second determining unit 402; and in details, the adjusting unit 403 is configured to receive the backlight value generated by the second determining unit 402, and to drive a drive circuit of the liquid crystal display device according to the backlight value to generate the corresponding backlight brightness for the image to be displayed.

Figure 5:
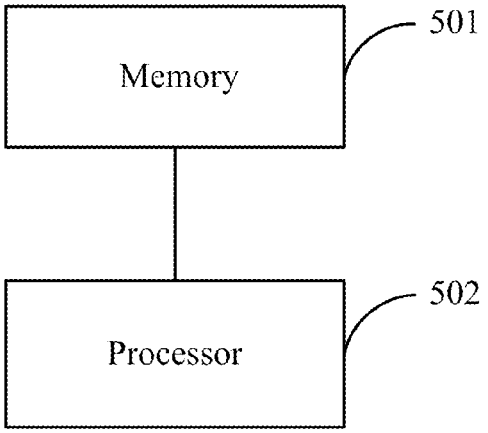
FIG. 5 illustrates a schematic structural diagram of another backlight brightness adjusting device according to some embodiments of the disclosure.

Referring to FIG. 5, some embodiments of the disclosure further provide a backlight brightness adjusting device including a memory 501, and a processor 502, where:

The memory 501 stores one or more program codes configured to be executed by the one or more processor 502. The one or more program codes include instructions for performing the method as illustrated in FIG. 1 to FIG. 3, and reference may be made to FIG. 1 to FIG. 3 and the related description thereof for the disclosure of the method.

In another aspect, some embodiments of the disclosure further provide a computer readable storage medium which may be a computer readable storage medium included in the memory in the embodiment above; or may be a separately existing computer readable storage medium which is not installed into the liquid crystal display device. The computer readable storage medium stores one or more programs (in some embodiments, the computer readable storage medium may be one or more magnetic-disk storage devices, flash memory devices or other nonvolatile solid storage devices, CD-ROMs, optical memories, etc.), and the one or more programs may be executed by the one or more processors to perform the backlight brightness adjusting method according to the embodiment of the disclosure. For operations included in the method, reference may be made to the relevant description of the embodiments illustrated in FIG. 1 to FIG. 3, so a repeated description thereof will be omitted here.

Additionally some embodiments of the disclosure further provide a liquid crystal display device which may include the backlight brightness adjusting device according to the embodiment above, including a memory 501, and a processor 502, where:

The memory 501 stores one or more program codes configured to be executed by the one or more processor 502. The one or more program codes include instructions for performing the method as illustrated in FIG. 1 to FIG. 3, and reference may be made to FIG. 1 to FIG. 3 and the related description thereof for the disclosure of the method.

Some embodiments of the disclosure further provide a liquid crystal display device including the backlight brightness adjusting device above.

Figure 6:
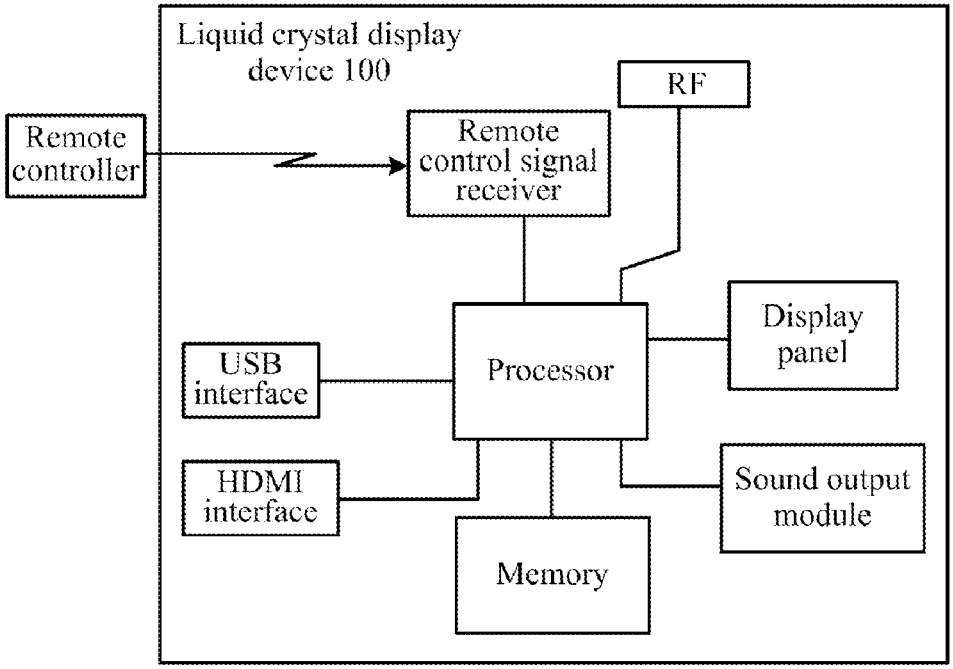
FIG. 6 illustrates a schematic structural diagram of a liquid crystal display device according to some embodiments of the disclosure.

FIG. 6 illustrates a schematic structural diagram of a liquid crystal display device according to some embodiments of the disclosure, which may include a memory, an input unit, an output unit, one or more processors and other components. Those skilled in the art may appreciate that the structure of the liquid crystal display device illustrated in FIG. 6 will not be intended to be limiting on the liquid crystal display device, but more or less components than those as illustrated may be included or some of the components may be combined or the components may be arranged differently, where:

The memory may be configured to store software programs and modules, and the processor or processors may run the software programs and the modules stored in the memory to thereby perform various function applications and data processing. The memory may include a high-speed random access memory and may further include a nonvolatile memory, e.g., at least one magnetic-disk memory device, a flash memory device or another volatile solid memory device. Correspondingly the memory may further include a memory controller configured to provide an access of the processor or the processors and the input device to the memory; and The processor or processors is or are a control center of the liquid crystal display device 100, has the respective components throughout the liquid crystal display device connected by various interfaces and lines, and runs or executes the software programs and/or the modules stored in the memory and invokes the data stored in the memory to perform the various functions of the liquid crystal display device 100 and to process the data to thereby manage and control the liquid crystal display device as a whole. Optionally the processor or processors may include one or more processing cores; and optionally the processor or processors may be integrated with an application processor and a modem processor, where the application processor generally handles the operating system, the user interfaces, the applications, etc., and the modem processor generally handles wireless communication. As may be appreciated, the modem processor above may not be integrated into the processor or processors.

The liquid crystal display device 100 may further include a TV and radio receiver, a high-definition multimedia interface, a USB interface, an audio and video input structure and other input units, and the input unit may further include a remote control receiver to receive a signal transmitted by a remote controller. Moreover the input unit may further include a touch sensitive surface and other input devices, where the touch sensitive surface may be embodied in various types of resistive, capacitive, infrared, surface sound wave and other types, and the other input device may include but will not be limited to one or more of a physical keyboard, functional keys (e.g., volume control press keys, a power-on or-off press key, etc.), a track ball, a mouse, a joystick, etc.

The output unit is configured to output an audio signal, a video signal, an alert signal, a vibration signal, etc. The output unit may include a display panel, a sound output module, etc. The display panel may be configured to display information input by the user or information provided to the user and various graphic user interfaces of the liquid crystal display device 100, where these graphic user interfaces may be composed of graphics, texts, icons, videos and any combination thereof. For example, the display panel may be embodied as a Liquid Crystal Display (LCD), an Organic Light-Emitting Diode (OLED), a flexible display, a 3D display, a CRT, a plasma display panel, etc.

The liquid crystal display device 100 may further include at least one sensor (not illustrated), e.g., an optical sensor, a motion sensor and other sensors. Particularly the optical sensor may include an ambient optical sensor and a proximity sensor, where the ambient optical sensor may adjust the brightness of the display panel according to the luminosity of ambient light rays, and the proximity sensor may power off the display panel and/or a backlight when the liquid crystal display device 100 moves to some position. The liquid crystal display device may be further configured with a gyroscope, a barometer, a hygrometer, a thermometer, an infrared sensor and other sensors.

The liquid crystal display device may further include an audio circuit (not illustrated), and a speaker and a transducer may provide an audio interface between the user and the liquid crystal display device 100. The audio circuit may convert received audio data into an electric signal and transmit the electric signal to the speaker, which is converted by the speaker into an audio signal for output; and on the other hand, the transducer converts a collected audio signal into an electric signal which is received by the audio circuit and then converted into audio data, and the audio data is further output to the processor or processors for processing and then transmitted to another liquid crystal display device, for example, or the audio data is output to the memory for further processing. The audio circuit may further include an earphone jack for communication between a peripheral earphone and the liquid crystal display device 100.

Moreover the liquid crystal display device may further include a Radio Frequency (RF) circuit. The RF circuit may be configured to receive and transmit a signal. Typically the RF circuit includes but will not be limited to an antenna, at least one amplifier, a tuner, one or more oscillators, a Subscriber Identifier Module (SIM) card, a transceiver, a coupler, a Low Noise Amplifier (LNA), a duplexer, etc. Moreover the liquid crystal display device may further include a web cam, a Bluetooth module, etc.

Moreover the liquid crystal display device may further include a Wireless Fidelity (WiFi) module (not illustrated). The WiFi falls into the category of short-range wireless transmission technologies, and the liquid crystal display device may assist the user in receiving and transmitting an e-mail, browsing a webpage, accessing streaming media, etc., through the WiFi module by which the user is provided with a wireless access to the broadband Internet. Although the WiFi module is illustrated in FIG. 6, it may be appreciated that it may not be necessarily required for the liquid crystal display device but may be omitted as desired without departing from the scope of the disclosure.

In the embodiments above, firstly the grayscale characteristic values of the respective primary colors in the image to be displayed are obtained, that is, the contributions of the respective primary colors to the overall grayscale are obtained, to thereby obtain the grayscale contributions of the respective primary colors in the image to be displayed respectively; the backlight value is determined by giving the different coefficients to the grayscale characteristic values of the respective primary colors, where the coefficient corresponding to the blue color is the maximum of the coefficients corresponding to the respective primary colors; and finally the output of the backlight driver is adjusted according to the backlight value to thereby adjust the backlight brightness. The contributions of the respective primary colors in the image to be displayed to the overall grayscale are determined, and the grayscale characteristic value of the blue color is given the higher coefficient, to thereby adjust the backlight brightness. Since the coefficient corresponding to the blue color is larger than the coefficients corresponding to the other two primary colors, the backlight for the blue image may be provided with higher backlight brightness to thereby improve the display performance of the liquid crystal display device.

As may be apparent from the disclosure above, the grayscale characteristic values of the respective primary colors in the image to be displayed are obtained, that is, the contributions of the respective primary colors to the overall grayscale are obtained, to thereby obtain the grayscale contributions of the respective primary colors in the image to be displayed respectively; the backlight value is determined by giving different coefficients to the grayscale characteristic values of the respective primary colors, where the coefficient corresponding to the blue color is the maximum of the coefficients corresponding to the respective primary colors; and finally the output of the backlight driver is adjusted according to the backlight value to thereby adjust the backlight brightness. In this solution, the contributions of the primary colors in the image to be displayed to the overall grayscale are determined, and the grayscale characteristic value of the blue color is given the higher coefficient, to thereby adjust the backlight brightness. Since the coefficient corresponding to the blue color is larger than the coefficients corresponding to the other two primary colors, the backlight for the blue image may be provided with higher backlight brightness to thereby satisfy a visual demand of human beings.

In some embodiments above, technical solutions of this disclosure are described taking the primary colors including red, green and blue colors as an example. It should be noted that the technical solutions in some embodiments above may also be applicable to a circumstance that the primary colors include red, green, blue and white colors, and applicable to another circumstance that the primary colors include other colors. Those skilled in the art shall appreciate that the embodiments of the disclosure may be embodied as a method, a system or a computer program product. Therefore the disclosure may be embodied in the form of an all-hardware embodiment, an all-software embodiment or an embodiment of software and hardware in combination. Furthermore the disclosure may be embodied in the form of a computer program product embodied in one or more computer useable storage mediums (including but not limited to a disk memory, a CD-ROM, an optical memory, etc.) in which computer useable program codes are contained.

The disclosure has been described in a flow chart and/or a block diagram of the method, the device (system) and the computer program product according to the embodiments of the disclosure. It shall be appreciated that respective flows and/or blocks in the flow chart and/or the block diagram and combinations of the flows and/or the blocks in the flow chart and/or the block diagram may be embodied in computer program instructions. These computer program instructions may be loaded onto a general-purpose computer, a specific-purpose computer, an embedded processor or a processor of another programmable data processing device to produce a machine so that the instructions executed on the computer or the processor of the other programmable data processing device create means for performing the functions specified in the flow(s) of the flow chart and/or the block(s) of the block diagram.

These computer program instructions may also be stored into a computer readable memory capable of directing the computer or the other programmable data processing device to operate in a specific manner so that the instructions stored in the computer readable memory create an article of manufacture including instruction means which perform the functions specified in the flow(s) of the flow chart and/or the block(s) of the block diagram.

These computer program instructions may also be loaded onto the computer or the other programmable data processing device so that a series of operational operations are performed on the computer or the other programmable data processing device to create a computer implemented process so that the instructions executed on the computer or the other programmable device provide operations for performing the functions specified in the flow(s) of the flow chart and/or the block(s) of the block diagram.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A backlight brightness adjusting method for a liquid crystal display device, the method comprising:

obtaining grayscale characteristic values of respective primary colors in an image to be displayed, the grayscale characteristic values of the respective primary colors characterizing contributions of grayscales of the respective primary colors to a grayscale of the image to be displayed;

determining a first product of a red one of the grayscale characteristic values and a first coefficient corresponding to a red color, determining a second product of a green one of the grayscale characteristic values and a second coefficient corresponding to a green color, and determining a third product of a blue one of the grayscale characteristic values and a third coefficient corresponding to a blue color;

summing the first product, the second product and the third product to obtain the backlight value; and adjusting a backlight brightness according to the backlight value.

2. The method according to claim 1, wherein summing the first product, the second product, and the third product to obtain the backlight value comprises:

calculating the sum of the first product, the second product, and the third product; and setting the backlight value to the sum of the first product, the second product, and the third product when the sum of the first product, the second product, and the third product is no more than 255.

3. The method according to claim 2, wherein the first coefficient is larger than the second coefficient.

4. The method according to claim 1, wherein obtaining the grayscale characteristic values of the respective primary colors in the image to be displayed comprises:

obtaining grayscales of respective pixels in the image to be displayed;

determining first grayscales and grayscale proportions of the respective primary colors in the image to be displayed according to the grayscales of the respective pixels; and determining the grayscale characteristic values of the respective primary colors according to the products of the first grayscales and the grayscale proportions of the respective primary colors.

5. The method according to claim 4, wherein determining the first grayscales of the respective primary colors in the image to be displayed according to the grayscales of the respective pixels comprises:

determining a red first grayscale in the image to be displayed according to red grayscales of the respective pixels;

determining a green first grayscale in the image to be displayed according to green grayscales of the respective pixels; and determining a blue first grayscale in the image to be displayed according to blue grayscales of the respective pixels.

6. The method according to claim 5, wherein determining the red first grayscale in the image to be displayed according to the red grayscales of the respective pixels comprises:

calculating an average of red grayscales of all pixels in the image to be displayed, and weighted summing up a maximum of the red grayscales of all the pixels in the image to be displayed and the average of the red grayscales of all the pixels in the image to be displayed to obtain the red first grayscale in the image to be displayed;

determining the green first grayscale in the image to be displayed according to the green grayscales of the respective pixels comprises:

calculating an average of the green grayscales of all the pixels in the image to be displayed, and weighted summing up a maximum of the green grayscales of all the pixels in the image to be displayed and the average of the green grayscales of all the pixels in the image to be displayed to obtain the green first grayscale in the image to be displayed; and determining the blue first grayscale in the image to be displayed according to the blue grayscales of the respective pixels comprises:

calculating an average of the blue grayscales of all the pixels in the image to be displayed, and weighted summing up a maximum of the blue grayscales of all the pixels in the image to be displayed and the average of the blue grayscales of all the pixels in the image to be displayed to obtain the blue first grayscale in the image to be displayed.

7. The method according to claim 4, wherein determining the grayscale proportions of the respective primary colors in the image to be displayed according to the grayscales of the respective pixels comprises:

summing up red grayscales of the respective pixels in the image to be displayed to obtain a sum of the red grayscales of all pixels $R_1$, summing up green grayscales of the respective pixels in the image to be displayed to obtain a sum of the green grayscales of all the pixels $G_1$, and summing up blue grayscales of the respective pixels in the image to be displayed to obtain a sum of the blue grayscales of all the pixels $B_1$; and determining a red grayscale proportion R, a green grayscale proportion G, and a blue grayscale proportion B corresponding to the image to be displayed respectively in the equations of $$R = \frac{R_1}{R_1 + G_1 + B_1},\ G = \frac{G_1}{R_1 + G_1 + B_1} \text{ and } B = \frac{B_1}{R_1 + G_1 + B_1}.$$

8. A backlight brightness adjusting device for a liquid crystal display device, the backlight brightness adjusting device comprising:

a memory; and one or more processors, the memory storing one or more computer readable program codes, and the one or more processors configured to execute the one or more computer readable program codes to perform:

obtaining grayscale characteristic values of respective primary colors in an image to be displayed, the grayscale characteristic values of the respective primary colors characterizing contributions of grayscales of the respective primary colors to a grayscale of the image to be displayed;

determining a first product of a red one of the grayscale characteristic values and a first coefficient corresponding to a red color, determining a second product of a green one of the grayscale characteristic values and a second coefficient corresponding to a green color, and determining a third product of a blue one of the grayscale characteristic values and a third coefficient corresponding to a blue color;

summing the first product, the second product and the third product to obtain the backlight value; and adjusting a backlight brightness according to the backlight value.

9. The backlight brightness adjusting device according to claim 8, wherein summing the first product, the second product, and the third product to obtain the backlight value comprises:

calculating the sum of the first product, the second product, and the third product; and setting the backlight value to the sum of the first product, the second product, and the third product when the sum of the first product, the second product, and the third product is no more than 255.

10. The backlight brightness adjusting device according to claim 9, wherein the first coefficient is larger than the second coefficient.

11. The backlight brightness adjusting device according to claim 8, wherein obtaining the grayscale characteristic values of the respective primary colors in the image to be displayed comprises:

obtaining grayscales of respective pixels in the image to be displayed;

determining first grayscales and grayscale proportions of the respective primary colors in the image to be displayed according to the grayscales of the respective pixels; and determining the grayscale characteristic values of the respective primary colors according to the products of the first grayscales and the grayscale proportions of the respective primary colors.

12. The backlight brightness adjusting device according to claim 11, wherein determining the first grayscales of the respective primary colors in the image to be displayed according to the grayscales of the respective pixels comprises:

determining a red first grayscale in the image to be displayed according to red grayscales of the respective pixels;

determining a green first grayscale in the image to be displayed according to green grayscales of the respective pixels; and determining a blue first grayscale in the image to be displayed according to blue grayscales of the respective pixels.

13. The backlight brightness adjusting device according to claim 12, wherein determining the red first grayscale in the image to be displayed according to the red grayscales of the respective pixels comprises:

calculating an average of red grayscales of all pixels in the image to be displayed, and weighted summing up a maximum of the red grayscales of all the pixels in the image to be displayed and the average of the red grayscales of all the pixels in the image to be displayed to obtain the red first grayscale in the image to be displayed;

determining the green first grayscale in the image to be displayed according to the green grayscales of the respective pixels comprises:

calculating an average of the green grayscales of all the pixels in the image to be displayed, and weighted summing up a maximum of the green grayscales of all the pixels in the image to be displayed and the average of the green grayscales of all the pixels in the image to be displayed to obtain the green first grayscale in the image to be displayed; and determining the blue first grayscale in the image to be displayed according to the blue grayscales of the respective pixels comprises:

calculating an average of the blue grayscales of all the pixels in the image to be displayed, and weighted summing up a maximum of the blue grayscales of all the pixels in the image to be displayed and the average of the blue grayscales of all the pixels in the image to be displayed to obtain the blue first grayscale in the image to be displayed.

14. The backlight brightness adjusting device according to claim 11, wherein determining the grayscale proportions of the respective primary colors in the image to be displayed according to the grayscales of the respective pixels comprises:

summing up red grayscales of the respective pixels in the image to be displayed to obtain a sum of the red grayscales of all pixels $R_1$, summing up green grayscales of the respective pixels in the image to be displayed to obtain a sum of the green grayscales of all the pixels $G_1$, and summing up blue grayscales of the respective pixels in the image to be displayed to obtain a sum of the blue grayscales of all the pixels $B_1$; and determining a red grayscale proportion R, a green grayscale proportion G, and a blue grayscale proportion B corresponding to the image to be displayed respectively in the equations of $$R = \frac{R_1}{R_1 + G_1 + B_1},\ G = \frac{G_1}{R_1 + G_1 + B_1} \text{ and } B = \frac{B_1}{R_1 + G_1 + B_1}.$$

15. A liquid crystal display device comprising:

a backlight brightness adjusting device, the backlight brightness adjusting device comprising:

a memory; and one or more processors, the memory storing one or more computer readable program codes, the one or more processors configured to execute the one or more computer readable program codes to perform:

obtaining grayscale characteristic values of respective primary colors in an image to be displayed, the grayscale characteristic values of the respective primary colors characterizing contributions of grayscales of the respective primary colors to a grayscale of the image to be displayed;

determining a first product of a red one of the grayscale characteristic values and a first coefficient corresponding to a red color, determining a second product of a green one of the grayscale characteristic values and a second coefficient corresponding to a green color, and determining a third product of a blue one of the grayscale characteristic values and a third coefficient corresponding to a blue color;

summing the first product, the second product and the third product to obtain the backlight value; and adjusting a backlight brightness according to the backlight value.

16. The liquid crystal display device according to claim 15, wherein summing up the first product, the second product, and the third product to obtain the backlight value comprises:

calculating the sum of the first product, the second product, and the third product; and setting the backlight value to the sum of the first product, the second product, and the third product when the sum of the first product, the second product, and the third product is no more than 255.

17. The liquid crystal display device according to claim 16, wherein the first coefficient is larger than the second coefficient.

* * * * *